US010099472B2

(12) United States Patent
Samoto

(10) Patent No.: US 10,099,472 B2
(45) **Date of Patent: *Oct. 16, 2018**

(54) IMAGE RECORDING APPARATUS

(71) Applicant: BROTHER KOGYO KABUSHIKI KAISHA, Nagoya-shi, Aichi-ken (JP)

(72) Inventor: Kenji Samoto, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/458,226

(22) Filed: Mar. 14, 2017

(65) Prior Publication Data

US 2018/0001617 A1 Jan. 4, 2018

Related U.S. Application Data

(63) Continuation of application No. 15/153,832, filed on May 13, 2016, now Pat. No. 9,610,765, which is a (Continued)

(30) Foreign Application Priority Data

Mar. 31, 2014 (JP) ..... 2014-074326

(51) Int. Cl.
*B41J 11/00* (2006.01)
*B41J 2/01* (2006.01)
*B41J 11/04* (2006.01)

(52) U.S. Cl.
CPC ..... *B41J 2/01* (2013.01); *B41J 11/005* (2013.01); *B41J 11/04* (2013.01); *B41J 11/0045* (2013.01)

(58) Field of Classification Search
CPC ... B41J 2/01; B41J 11/04; B41J 11/005; B41J 11/0045
See application file for complete search history.

(56) References Cited

U.S. PATENT DOCUMENTS 5,673,074 A * 9/1997 Miyauchi ..... B41J 11/005 346/134
8,322,844 B2 12/2012 Toya
(Continued)

FOREIGN PATENT DOCUMENTS

CN 1061195 5/1992
CN 1496855 A 5/2004
(Continued)

OTHER PUBLICATIONS

Chinese Office Action issued in related Chinese Patent Application No. CN201510144114.8, dated Aug. 1, 2017.
(Continued)

*Primary Examiner* — Yaovi M Ameh
(74) *Attorney, Agent, or Firm* — Merchant & Gould P.C.

(57) ABSTRACT

A plurality of first contact portions is arranged to face a second supporting member between a nipping position and nozzles in a conveying direction. The first contact portions are spaced away from each other in a width direction, and contact a sheet from a first side. A second contact portion is provided at least between two of the first contact portions in the width direction, and contacts the sheet from a second side. A regulating member is provided at a first supporting member. The regulating member extends to provide an extending end portion that is located at a position closer to a second supporting member than the nozzle surface is in a perpendicular direction. The extending end portion locates the first contact portions at a regulating position that is closer to the second supporting member than the nozzle surface is in the perpendicular direction.

10 Claims, 8 Drawing Sheets

Related U.S. Application Data continuation of application No. 14/665,922, filed on Mar. 23, 2015, now Pat. No. 9,340,043.

(56) References Cited

U.S. PATENT DOCUMENTS

| | | | | |
|---|---|---|---|---|
| 9,340,043 | B2 * | 5/2016 | Samoto | B41J 11/04 |
| 9,610,765 | B2 * | 4/2017 | Samoto | B41J 11/04 |
| 2004/0061911 | A1 | 4/2004 | Samoto | |
| 2006/0221166 | A1 | 10/2006 | Inoue | |
| 2009/0121422 | A1 | 5/2009 | Imoto | |
| 2013/0135388 | A1 | 5/2013 | Samoto et al. | |
| 2013/0135389 | A1 | 5/2013 | Ito | |
| 2013/0135393 | A1 | 5/2013 | Samoto | |
| 2013/0286127 | A1 | 10/2013 | Samoto | |
| 2014/0232799 | A1 * | 8/2014 | Sano | B41J 11/007 347/104 |

FOREIGN PATENT DOCUMENTS

| | | | | | |
|---|---|---|---|---|---|
| CN | 101331024 | A | | 12/2008 | |
| EP | 0 676 296 | A1 | | 3/1995 | |
| JP | 4-129769 | A | | 4/1992 | |
| JP | 2000-071532 | A | | 3/2000 | |
| JP | 2013-107271 | A | | 6/2013 | |
| JP | 2013-136225 | | * | 7/2013 | B41J 13/10 |
| JP | 2013-136225 | A | | 7/2013 | |

OTHER PUBLICATIONS

Japanese Office Action issued in corresponding Japanese Patent Application No. 2014-074326, dated Feb. 20, 2018.

* cited by examiner

IMAGE RECORDING APPARATUS

CROSS REFERENCE TO RELATED APPLICATIONS

This application is a continuation of U.S. patent application Ser. No. 15/153,832, filed May 13, 2016, which is a continuation of U.S. patent application Ser. No. 14/665,922, filed Mar. 23, 2015, and further claims priority from Japanese Patent Application No. 2014-074326 filed Mar. 31, 2014. The entire content of all applications are incorporated herein by reference.

TECHNICAL FIELD

The invention relates to an image recording apparatus.

BACKGROUND

An inkjet recording apparatus is conventionally known that ejects ink onto a sheet for recording an image. The inkjet recording apparatus has a mechanism that causes a sheet to undulate in order to suppress the sheet from separating up from a platen in connection with deformation of the sheet (cockling) due to adhesion of ink on the sheet.

SUMMARY

According to one aspect, this specification discloses an image recording apparatus. The image recording apparatus includes a casing, a roller pair, a recording device, a first supporting member, a second supporting member, a plurality of first contact portions, a second contact portion, and a regulating member. A conveying path is formed in the casing. The roller pair is arranged on the conveying path and is configured to hold a sheet at a nipping position and to convey the sheet in a conveying direction. The recording device includes a recording head having a nozzle surface formed with nozzles. The recording head is configured to eject liquid through the nozzles onto the sheet conveyed by the roller pair. The first supporting member supports the recording device. The first supporting member is provided at a first side that is one side of the conveying path. The second supporting member is configured to support the sheet. The second supporting member is provided at a second side that is an opposite side of the conveying path from the first side. The plurality of first contact portions is arranged to face the second supporting member between the nipping position and the nozzles of the recording head with respect to the conveying direction. The plurality of first contact portions is spaced away from each other in a width direction intersecting the conveying direction. The plurality of first contact portions is configured to contact the sheet from the first side. The second contact portion is provided at least between two of the plurality of first contact portions with respect to the width direction, and is configured to contact the sheet from the second side, thereby applying a wave form to the sheet in cooperation with the plurality of first contact portions. The regulating member is provided at the first supporting member. The regulating member extends to provide an extending end portion that is located at a position closer to the second supporting member than the nozzle surface is with respect to a perpendicular direction perpendicular to the nozzle surface. The extending end portion is configured to locate each of the plurality of first contact portions at a regulating position that is closer to the second supporting member than the nozzle surface is with respect to the perpendicular direction.

BRIEF DESCRIPTION OF THE DRAWINGS

Embodiments in accordance with the invention will be described in detail with reference to the following figures wherein.

DETAILED DESCRIPTION

Some aspects of the invention will be described while referring to the accompanying drawings. In the following descriptions, an upper-lower direction Z is defined in a state where a multifunction peripheral 10 is placed in an orientation in which it is intended to be used (the state of FIG. 1), a front-rear direction Y is defined by assuming that the side at which an opening 13 is formed is a near side (front side), and a left-right direction X is defined by viewing the multifunction peripheral 10 from the near side (front side).

[Overall Structure of Multifunction Peripheral 10]

Figure 1:
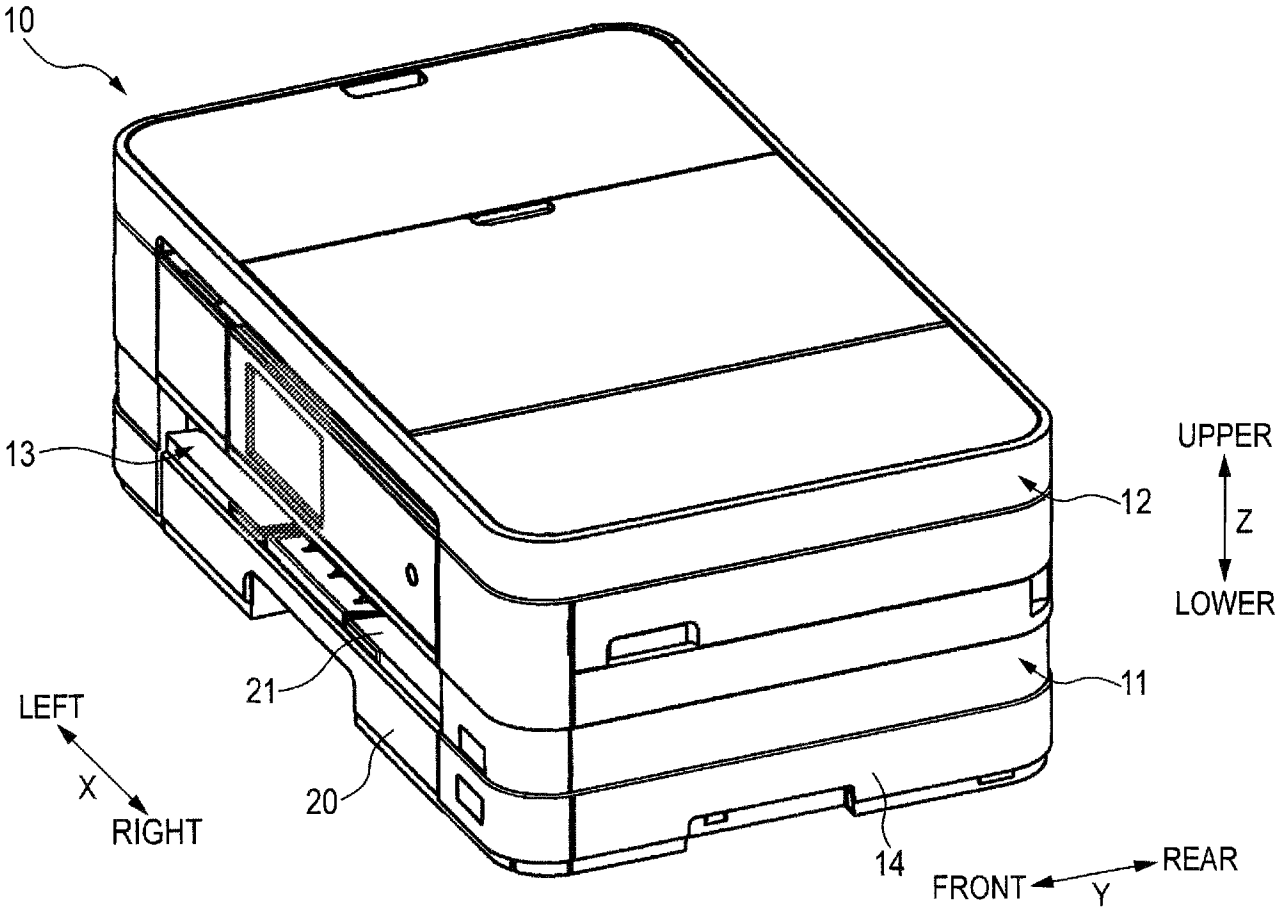
FIG. 1 is a perspective view showing a multifunction peripheral according to an embodiment of the invention.

As shown in FIG. 1, the multifunction peripheral 10 includes a casing 14 having an appearance of substantially rectangular parallelepiped shape. The multifunction peripheral 10 has various functions such as a facsimile function and a print function.

A scanner device 12 is provided at an upper part of the casing 14. The scanner device 12 is a so-called flatbed scanner. Here, detailed descriptions of the internal configuration of the scanner device 12 are omitted.

A printer device 11 (an example of an image recording apparatus) is provided at a lower part of the casing 14. The printer device 11 has a print function for recording an image on a recording sheet by an inkjet method. A base frame 83 (see FIG. 5), a pair of side frames 55, guide rails 56 and 57, a feeding tray 20, a feeding device 16, a conveying path 65, a recording device 24, roller pairs 59 and 44, guide members 18, 19, and 31, a roller holder 85, a contact member 41, a regulating member 80 (see FIG. 6), and so on, are arranged within the casing 14.

[Frame]

Figure 5:
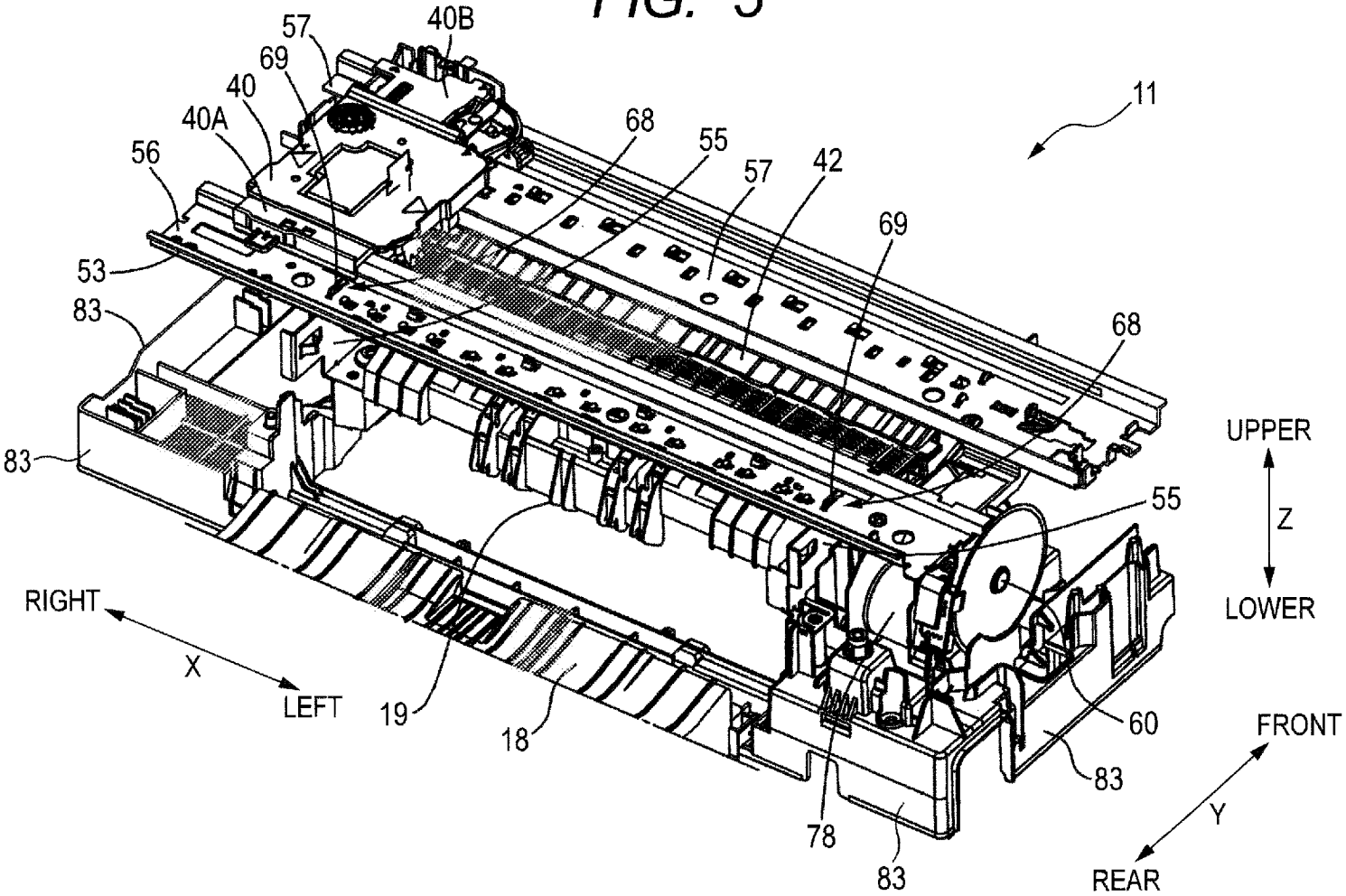
FIG. 5 is a perspective view showing a rear side of the printer device.

As shown in FIG. 5, at least three types of frames (the base frame 83, the pair of side frames 55, and the guide rails 56 and 57) are arranged within the casing 14.

The base frame 83 is a resin-made frame forming the structure of a lower part of the printer device 11. The pair of side frames 55 is arranged with an interval therebetween in the left-right direction X. The side frames 55 are arranged at the right and left sides of the conveying path 65. The side frames 55 are metal-made frames. The side frames 55 are supported by the base frame 83. The side frames 55 are fixed to the base frame 83 by screws or the like.

The guide rails 56 and 57 are arranged with an interval therebetween in the front-rear direction Y. The guide rails 56 and 57 are metal-made frames. The guide rails 56 and 57 are supported by the pair of side frames 55. A protruding portion 69 provided at the side frames 55 is inserted in an opening 68 formed at the guide rails 56 and 57. With this configuration, the side frames 55 are connected to the guide rails 56 and 57. Note that the side frames 55 may be connected to the guide rails 56 and 57 by a method other than the above-described method, such as fastening by screws. The guide rails 56 and 57 will be described later in greater details.

[Feeding Tray 20]

As shown in FIG. 1, the opening 13 is formed at the front side of the printer device 11. The feeding tray 20 is inserted into or removed from the printer device 11 through the opening 13 in the front-rear direction Y. In a state where the feeding tray 20 is inserted in the printer device 11, the feeding tray 20 is disposed at a lower side (a bottom side) of the casing 14. The feeding tray 20 is a box-shaped member of which the upper side is opened. A bottom plate 22 of the feeding tray 20 (see FIG. 2) supports recording sheets in a stacked state.

A discharging tray 21 is supported at the front side of the feeding tray 20. The discharging tray 21 moves in the front-rear direction Y integrally (together) with the feeding tray 20. A recording sheet on which an image is recorded by the recording device 24 is discharged onto an upper surface of the discharging tray 21.

[Feeding Device 16]

Figure 2:
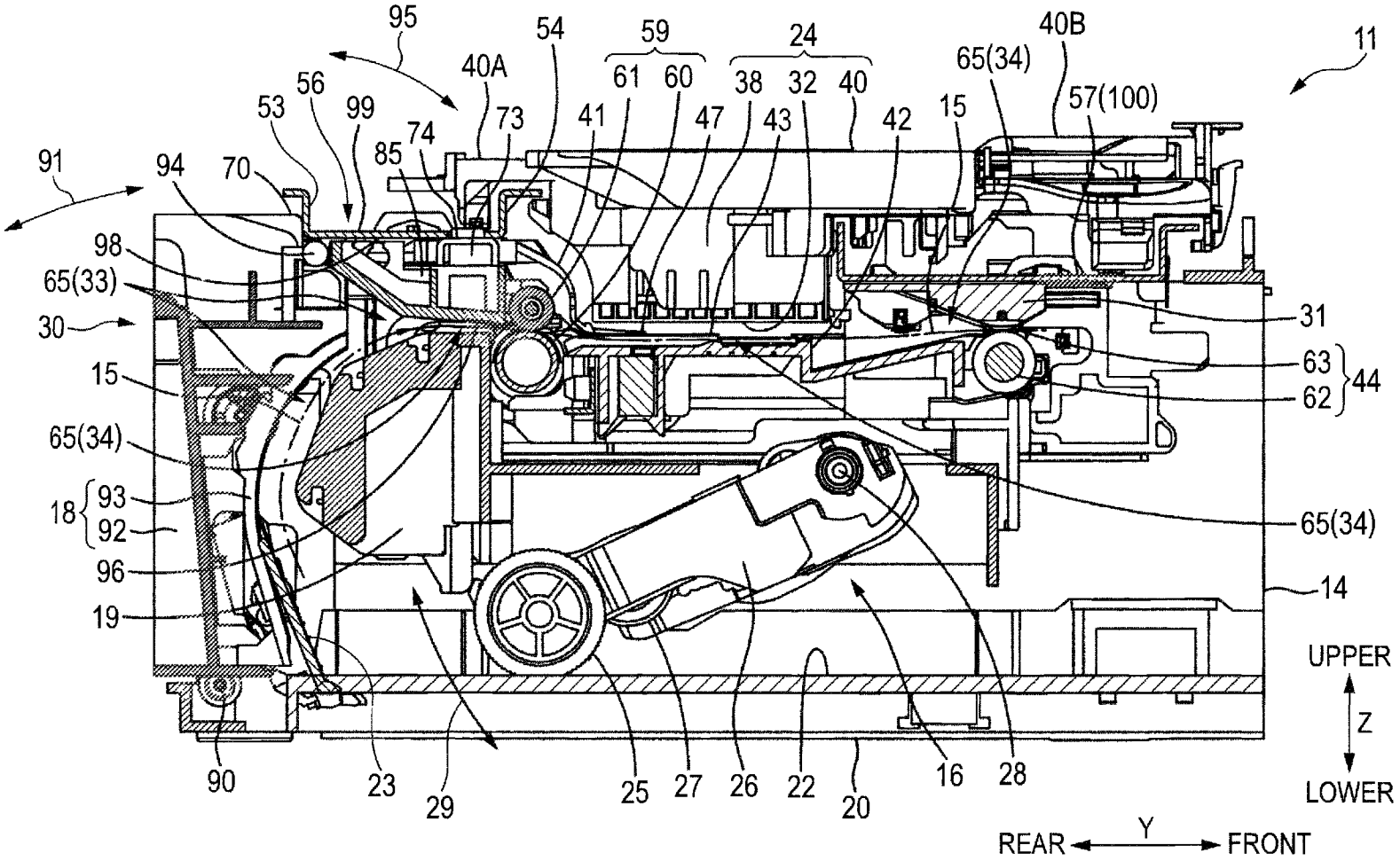
FIG. 2 is a vertical cross-sectional view showing an internal structure of a printer device in a state where an outer guide member is at a first position and where a roller holder is at a third position.

As shown in FIG. 2, the feeding device 16 is provided at a position below the recording device 24 and above the feeding tray 20 in a state where the feeding tray 20 is inserted in the printer device 11. The feeding device 16 includes a feeding roller 25, a feeding arm 26, and a drive transmitting mechanism 27. The feeding roller 25 is rotatably supported at a distal end of the feeding arm 26. The feeding arm 26 pivotally moves in the direction of an arrow 29 about a support shaft 28 provided at a base end of the feeding arm 26. With this configuration, the feeding roller 25 contacts or separates from the feeding tray 20 or a recording sheet supported by the feeding tray 20.

The drive transmitting mechanism 27 is constituted by a plurality of gears engaged with one another. Driving force of a motor 78 (see FIG. 5) is transmitted to the feeding roller 25 by the drive transmitting mechanism 27 so that the feeding roller 25 rotates. With this mechanism, an uppermost recording sheet in contact with the feeding roller 25, out of recording sheets supported by the bottom plate 22, is fed along the conveying path 65.

Note that driving force may be transmitted to the feeding roller 25 by a motor other than the motor 78. The configuration of the drive transmitting mechanism 27 is not limited to the plurality of gears engaged with one another. For example, the drive transmitting mechanism 27 may be a belt wound around the support shaft 28 and the shaft of the feeding roller 25.

[Conveying Path 65]

As shown in FIG. 2, the conveying path 65 extends from a rear end of the feeding tray 20. The conveying path 65 includes a curved portion 33 and an extending portion 34. The curved portion 33 extends from the rear end of the feeding tray 20 while being curved upward and frontward. The extending portion 34 continues from the upper end of the curved portion 33, and extends in the front-rear direction Y.

The curved portion 33 is defined between an inner unit (the inner guide member 19) and an outer unit (the outer guide member 18, the roller holder 85, and a slanted plate 23) that face each other with a predetermined interval therebetween. The extending portion 34 is defined between an upper unit (the roller holder 85, the recording device 24, and the upper guide member 31) and a lower unit (the inner guide member 19 and a platen 42).

A recording sheet supported by the feeding tray 20 is fed to the slanted plate 23 of the feeding tray 20 by the feeding roller 25. The slanted plate 23 changes the moving direction of the recording sheet, and the recording sheet enters the curved portion 33. The recording sheet having entered the curved portion is conveyed upward through the curved portion 33 in a U-shape, and arrives at a pair of conveying rollers 59 (an example of a roller pair). The recording sheet held by the pair of conveying rollers 59 is conveyed through the extending portion 34 toward the recording device 24 in the front-rear direction Y. The recording device 24 records an image on the recording sheet that arrives at a position directly below the recording device 24. The recording sheet on which the image is formed is conveyed through the extending portion 34 in the front-rear direction Y, and is discharged to the discharging tray 21. In this way, the recording sheet is conveyed along a conveying direction 15 that is shown by an arrow of a single-dot chain line in FIG. 2.

[Recording Device 24]

Figure 8:
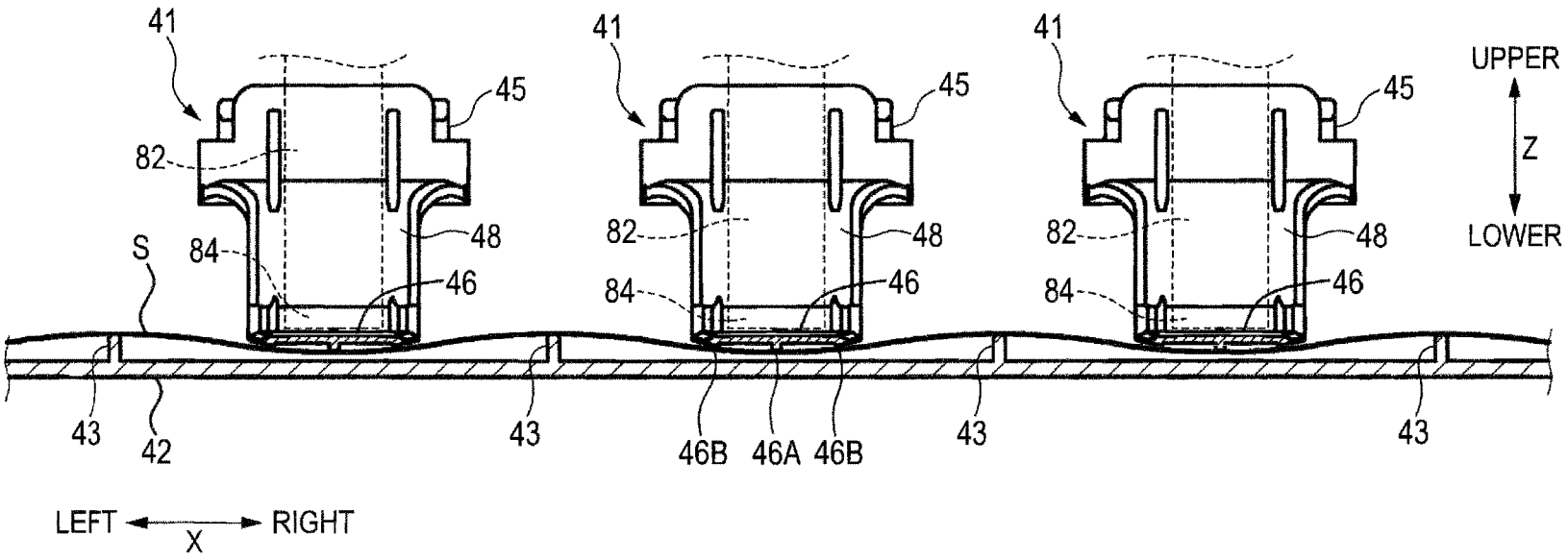
FIG. 8 is a cross-sectional view schematically showing a contact member, a platen, and a recording sheet.

As shown in FIG. 2, the recording device 24 is provided above the extending portion 34. The platen 42 is provided at a position below the recording device 24 and in confrontation with the recording device 24. The platen 42 includes ribs 43 (an example of a second contact portion). Each rib 43 stands from an upper surface of the platen 42 and extends in the front-rear direction Y. The plurality of ribs 43 is arranged with intervals therebetween in the left-right direction X. One rib 43 is provided in each interval between adjacent two of the contact members 41 with respect to the left-right direction X (FIG. 8). More specifically, at least part of the rib 43 (a rear side of the rib 43 in the present embodiment) is located between front end portions 46 of the adjacent contact members 41 with respect to the left-right direction X. Note that the contact member 41 will be described later in greater detail. The ribs 43 support a recording sheet that is conveyed through the extending portion 34 of the conveying path 65.

The recording device 24 includes a carriage 40 and a recording head 38. The carriage 40 is supported by the guide rails 56 and 57 such that the carriage 40 moves in a reciprocating manner in the left-right direction X (an example of a width direction) perpendicular to the conveying direction 15. Note that the carriage 40 may be movable in a reciprocating manner in a direction intersecting the conveying direction 15, the direction being other than the left-right direction X. A rear end portion 40A of the carriage 40 is in contact with an upper surface 99 of the guide rail 56 (an example of a first surface). A front end portion 40B of the carriage 40 is in contact with an upper surface 100 of the guide rail 57.

The recording head 38 is mounted on the carriage 40. The recording head 38 is disposed at an opposite side from the platen 42 with respect to the extending portion 34. Ink is supplied to the recording head 38 from an ink cartridge (not shown). A plurality of nozzles 39 (schematically shown in FIG. 6) is formed in a lower surface 32 of the recording head 38 (an example of a nozzle surface). The lower surface 32 extends in the front-rear direction Y and in the left-right direction X. While the carriage 40 moves in the left-right direction X, the recording head 38 ejects ink droplets from the nozzles 39 toward the platen 42. With this operation, an image is formed on a recording sheet supported by the platen 42 when the recording sheet is conveyed along the extending portion 34.

[Contact Member 41]

Figure 3:
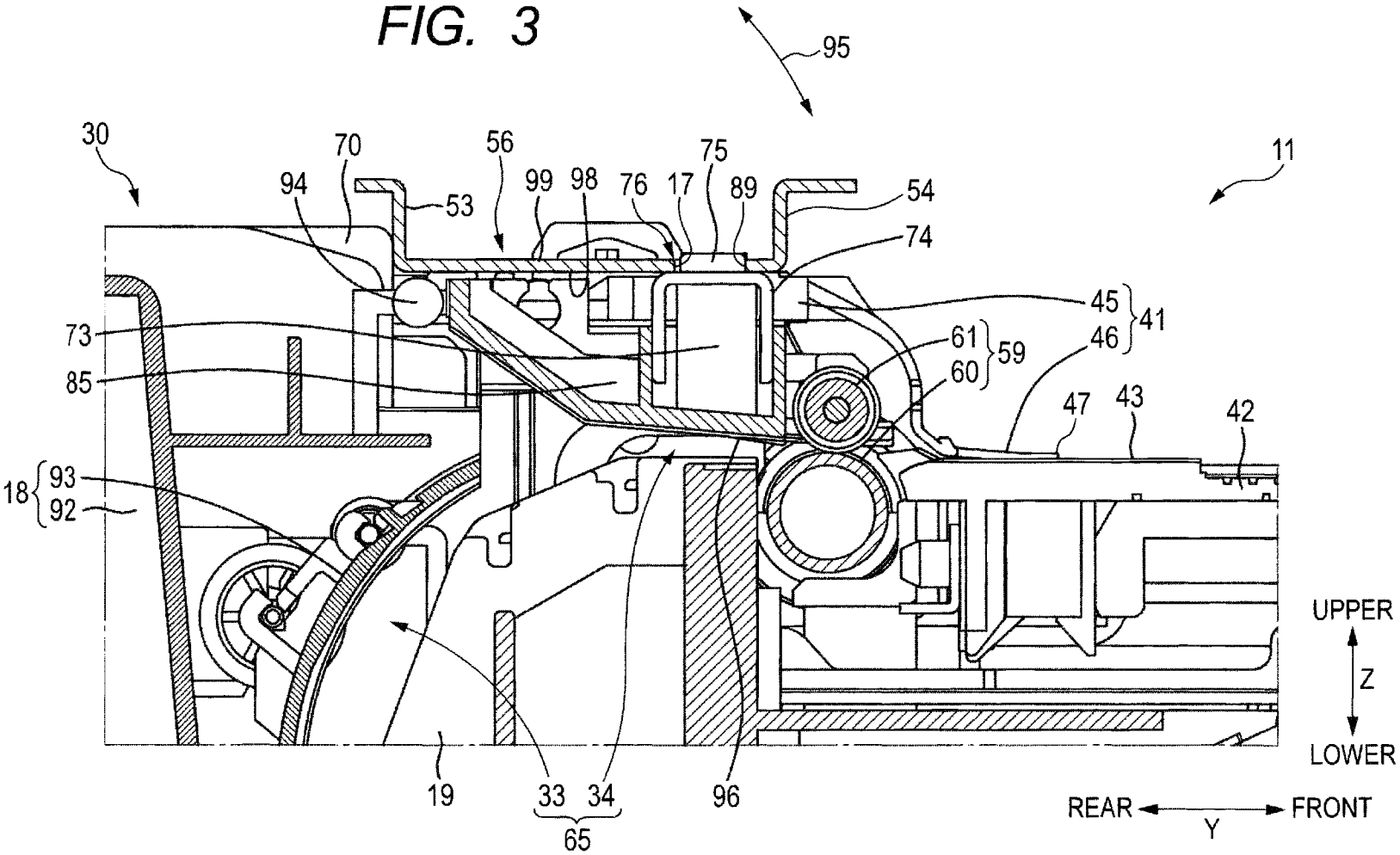
FIG. 3 is an enlarged view around the roller holder shown in FIG. 2.

As shown in FIGS. 2 and 3, the contact members 41 are arranged in the conveying path 65 at an upstream side of the recording device 24 in the conveying direction 15. The contact members 41 are molded by using resin such as polyacetal (POM) as the primary component. As shown in FIG. 8, the plurality of contact members 41 is arranged with intervals therebetween in the moving direction of the carriage 40 (the left-right direction X). Each contact member 41 is arranged between the adjacent ribs 43. As shown in FIGS. 2 and 3, a base end portion 45 of the contact member 41 is located at a rear side of the pair of conveying rollers 59, and is fixed to a lower surface 98 of the guide rail 56. Note that, as a method of attaching the base end portion 45 to the guide rail 56, various known methods such as fitting and screws may be adopted. The contact member 41 extends frontward and downward, while curving, from the base end portion 45.

Figure 6:
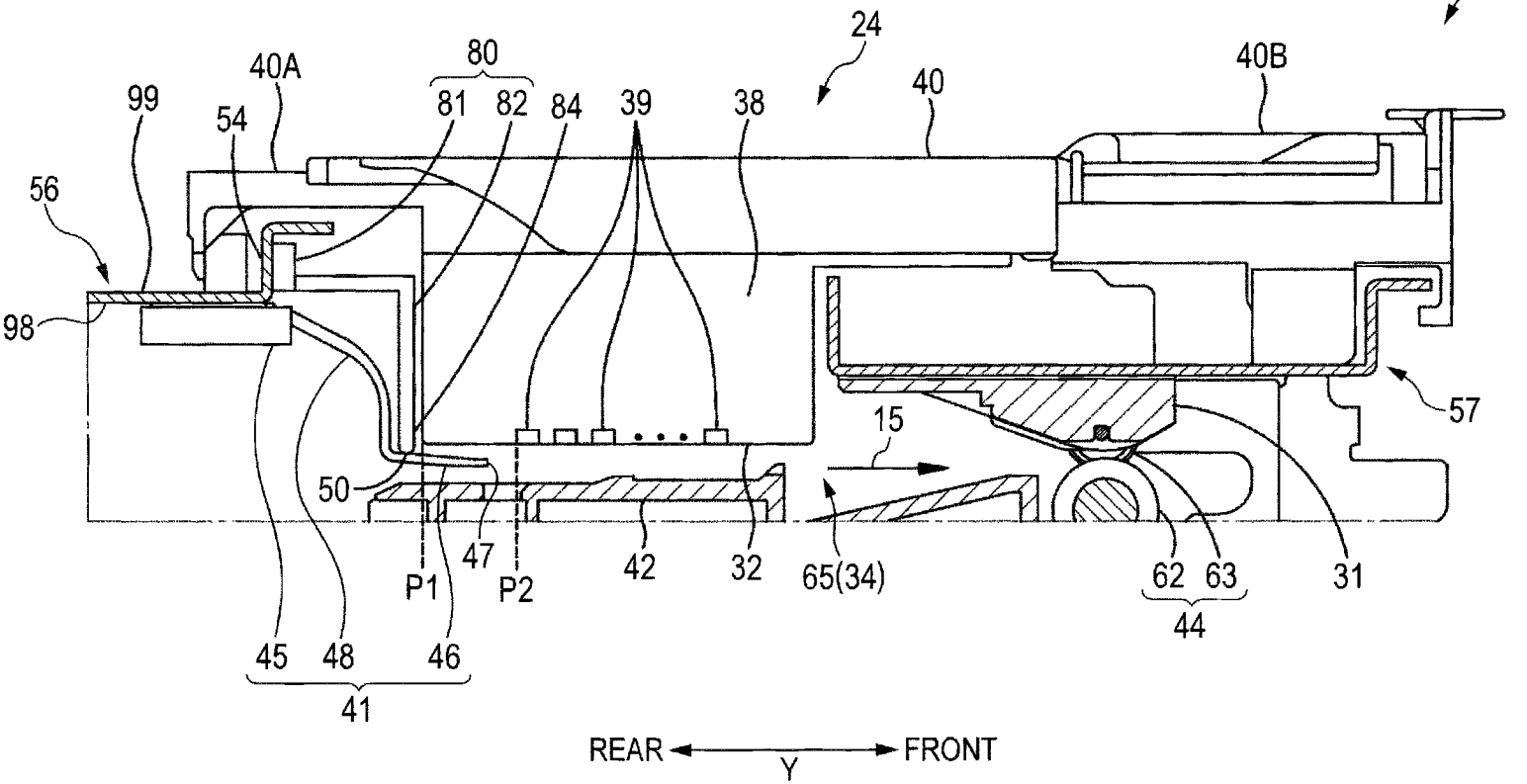
FIG. 6 is a vertical cross-sectional view schematically showing a recording device, guide rails, a contact member, and a regulating member.

More specifically, as shown in FIGS. 6 and 8, the contact member 41 includes a curved portion 48 that extends frontward and downward, while curving, from the base end portion 45. Then, the contact member 41 is bent toward the downstream side (the front side) at approximately 90 degrees at a position near a lower end portion 84 of the regulating member 80. The front end portion 46 is provided at the downstream side (the front side) of the bent portion. The front end portion 46 extends substantially horizontally in the front-rear direction and slightly slanted downward toward the downstream side.

As shown in FIG. 8, each front end portion 46 is provided with three protrusions (ribs) 46A and 46B. The protrusion 46A protrudes downward from a center of the front end portion 46 in the left-right direction. The protrusions 46B protrude downward from positions near both ends of the front end portion 46 in the left-right direction. The height (the size in the upper-lower direction) of the protrusion 46A is larger than the height of the protrusions 46B. The three protrusions 46A and 46B contact the sheet S from the upper side, thereby applying a wave form in cooperation with the ribs 43 that contact the sheet S from the lower side.

The contact member 41 extends to a position between the nozzles 39 and the nipping position of the pair of conveying rollers 59 with respect to the conveying direction 15. The front end portion 46 of the contact member 41 (an example of a first contact portion) extends to a position at a downstream side of an upstream end (rear end) of the rib 43 in the conveying direction 15. The lower end of a front end 47 of the front end portion 46 is located at a lower position than the upper end of the rib 43 (In FIG. 3, the lower end of the front end 47 is hidden by the rib 43). The front end 47 of the front end portion 46 contacts an upper surface of a recording sheet conveyed through the extending portion 34. As shown in FIG. 8, a recording sheet S is contacted by the front end portions 46 from upward and also contacted by the ribs 43 from downward, and becomes a wave form that continues in the left-right direction X. In this way, the front end portions 46 and the ribs 43 cooperate to apply a wave form to a recording sheet.

As shown in FIG. 6, the front end 47 of the front end portion 46 extends to a position closer to the nozzles 39 than an upstream end P1 of the recording head 38 in the conveying direction 15. With this configuration, the front end 47 is located between the upstream end P1 and a position P2 that is a position of the nozzle 39 at the upstream end in the conveying direction 15. Here, it is not always necessary that the front end 47 of the front end portion 46 extend to a position closer to the nozzles 39 than the upstream end P1 in the conveying direction 15. That is, the front end 47 may be located between the upstream end P1 and the nipping position of the pair of conveying rollers 59 in the conveying direction 15.

Note that the contact member 41 may have a configuration including one base end portion 45 extending in the left-right direction X, and a plurality of protruding portions provided with intervals therebetween in the left-right direction X and extending from the base end portion 45 in a curve shape.

[Pair of Conveying Rollers 59 and Pair of Discharge Rollers 44]

As shown in FIGS. 2 and 3, the pair of conveying rollers 59 is arranged at a position on the extending portion 34 at an upstream side of the recording device 24 in the conveying direction 15. The pair of discharge rollers 44 is arranged at a position on the extending portion 34 at a downstream side of the recording device 24 in the conveying direction 15.

The pair of conveying rollers 59 includes a conveying roller 60 and pinch rollers 61. The conveying roller 60 is disposed below the extending portion 34. The pinch rollers 61 are disposed above the extending portion 34 so as to face the conveying roller 60. The conveying roller 60 rotates about a rotational axis parallel to the left-right direction X. The plurality of pinch rollers 61 is provided with intervals therebetween in the left-right direction X. Each pinch roller 61 rotates about a rotational axis parallel to the left-right direction X. Each pinch roller 61 is pressed against the conveying roller 60 by a coil spring 73.

The conveying roller 60 is rotatably supported by the pair of side frames 55 (see FIG. 5). The pinch rollers 61 are rotatably supported by the roller holder 85.

The pair of discharge rollers 44 includes a discharge roller 62 and a spur roller 63. The discharge roller 62 is disposed below the extending portion 34. The spur roller 63 is disposed above the extending portion 34 so as to face the discharge roller 62. Each of the discharge roller 62 and the spur roller 63 rotates about a rotational axis parallel to the left-right direction X. The spur roller 63 is pressed against the discharge roller 62 by an elastic member (not shown). The discharge roller 62 is rotatably supported by the pair of side frames 55 (see FIG. 5). The spur roller 63 is rotatably supported by the upper guide member 31.

Driving force is transmitted to the conveying roller 60 and the discharge roller 62 from the motor 78 (see FIG. 5) so that the conveying roller 60 and the discharge roller 62 rotate. When the conveying roller 60 rotates in a state where a recording sheet is held between the pair of conveying rollers 59, the recording sheet is conveyed onto the platen 42 in the conveying direction 15 by the pair of conveying rollers 59.

Further, when the discharge roller 62 rotates in a state where a recording sheet is held between the pair of discharge rollers 44, the recording sheet is conveyed onto the discharging tray 21 in the conveying direction 15 by the pair of discharge rollers 44. Note that driving force may be transmitted to the conveying roller 60 and the discharge roller 62 by a motor other than the motor 78.

[Guide Rails 56 and 57]

The guide rails 56 and 57 shown in FIG. 2 are substantially a plate-shaped member extending in the front-rear direction Y and in the left-right direction X. As shown in FIGS. 2, 3, and 5, the guide rail 56 includes a rear bent portion 53 bent upward at a rear end portion and a front bent portion 54 bent upward at a front end portion. As shown in FIG. 2, the guide rail 56 is disposed at the rear side, and the guide rail 57 is disposed at the front side. The carriage 40 is disposed to bridge between the guide rails 56 and 57.

A known belt mechanism (not shown) is disposed on an upper side of the guide rail 57. The belt mechanism includes a pulley arranged at left and right end portions of the guide rail 57 and a belt looped around the pulley. The belt is connected to the carriage 40 and to a carriage driving motor (not shown) that applies driving force to the carriage 40. When the carriage driving motor is driven, driving force in the left-right direction X is transmitted to the carriage 40 via the belt mechanism. With this operation, the carriage 40 moves in a reciprocating manner in the left-right direction X.

[Guide Member 30]

As shown in FIG. 2, a guide member 30 is disposed at an upstream side of the recording device 24 in the conveying direction 15. The guide member 30 includes the outer guide member 18 and the roller holder 85. The outer guide member 18 is supported by the base frame 83 (see FIG. 5) such that the outer guide member 18 pivotally moves in directions of an arrow 91 about a shaft 90. The shaft 90 is provided at an upstream side of the outer guide member 18 in the conveying direction 15, and extends in the left-right direction X. With this configuration, the guide member 30 pivotally moves about the upstream side in the conveying direction 15, while the downstream side in the conveying direction 15 is the free end side of pivotal movement.

The outer guide member 18 is provided at the shaft 90 side of the guide member 30 (the upstream side of the curved portion 33 in the conveying direction 15). The roller holder 85 is provided at the free end side of pivotal movement of the guide member 30 (the downstream side of the curved portion 33 in the conveying direction 15).

An outer side of the curved portion 33 is defined by the outer guide member 18, the roller holder 85, and the slanted plate 23. Note that the outer side of the curved portion 33 may be defined by only the outer guide member 18 and the roller holder 85. Thus, the guide member 30 defines at least part of the outer side of the curved portion 33.

[Outer Guide Member 18]

As shown in FIG. 2, the outer guide member 18 pivotally moves in the directions of the arrow 91 about the shaft 90. The shaft 90 protrudes outward from both ends of the outer guide member 18 in the left-right direction X, at a position at the lower side (bottom side) of the casing 14. The shaft 90 is supported by a bearing (not shown) of the casing 14, and hence the outer guide member 18 is pivotally supported by the casing 14. In FIG. 5, the free end side of pivotal movement of the outer guide member 18 is not shown in the drawing.

The outer guide member 18 includes a side wall 92 and a guide section 93. The side wall 92 constitutes a part of a rear surface of the casing 14. The guide section 93 is provided at a front side of the side wall 92, and is supported by the side wall 92. The guide section 93 is a plate-shaped member that is curved at the curved portion 33 side.

Figure 4:
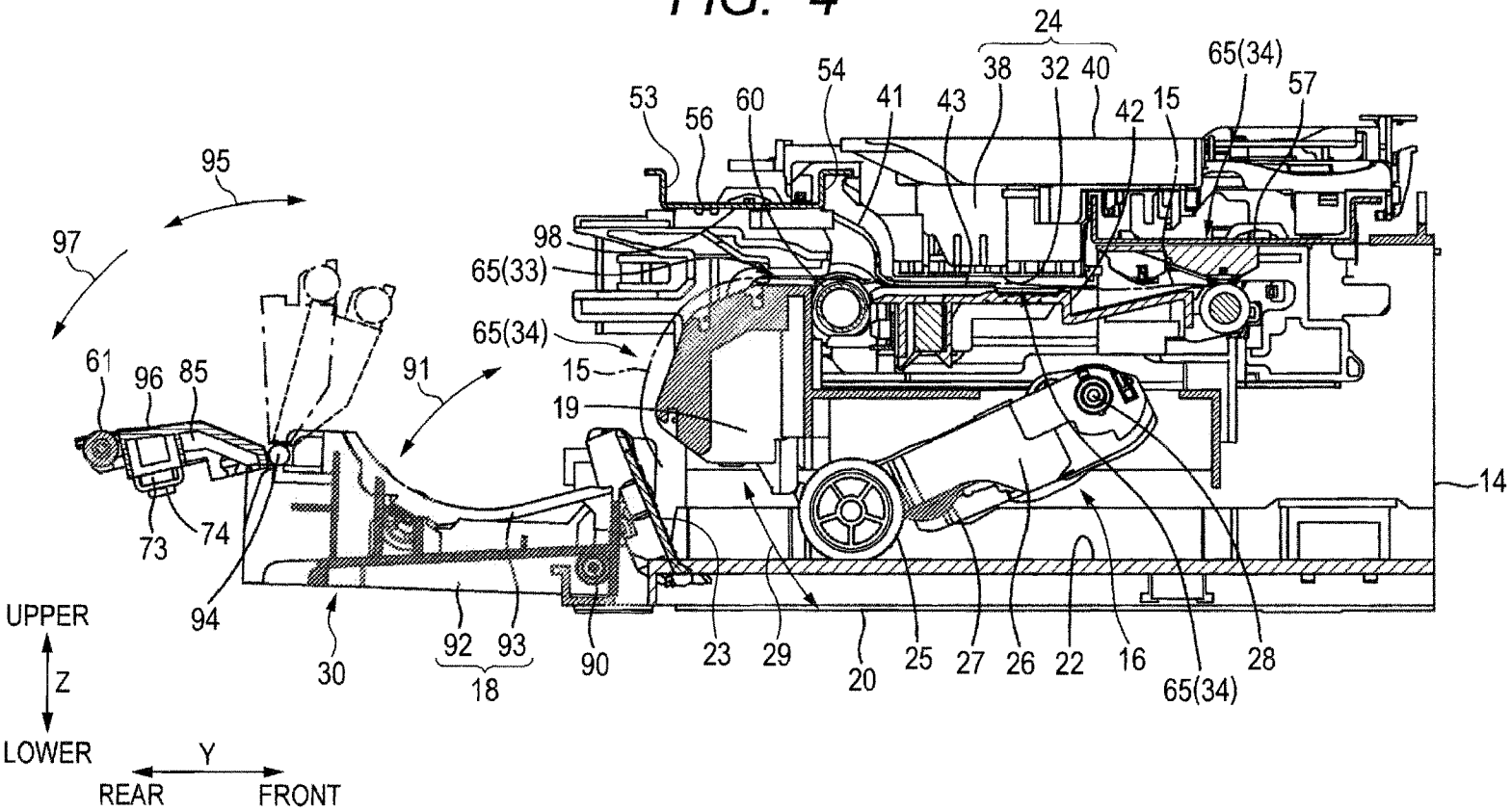
FIG. 4 is a vertical cross-sectional view showing an internal structure of the printer device in a state where the outer guide member is at a second position and where the roller holder is at a fourth position.

The outer guide member 18 pivotally moves between a first position shown in FIG. 2 and a second position shown in FIG. 4. When the outer guide member 18 is at the first position, the guide section 93 defines the outer side of the curved portion 33. On the other hand, when the outer guide member 18 is at the second position, the guide section 93 opens the curved portion 33. By pivotally moving the outer guide member 18 from the first position to the second position, a user of the multifunction peripheral 10 can take out a recording sheet that is jammed in the curved portion 33.

[Roller Holder 85]

As shown in FIGS. 2 and 3, the roller holder 85 is disposed below the guide rail 56. The roller holder 85 is a member that is elongated in the left-right direction X. The roller holder 85 supports each pinch roller 61 so as to be rotatable, at the front side of the roller holder 85.

A shaft 94 extending in the left-right direction X is provided at a rear end portion of the roller holder 85. The shaft 94 is supported by the outer guide member 18, and hence the roller holder 85 is connected to the outer guide member 18. The roller holder 85 pivotally moves integrally with the outer guide member 18 in the directions of the arrow 91, relative to the casing 14. Further, as shown in FIG. 4, the roller holder 85 pivotally moves about the shaft 94 in directions of an arrow 95, relative to the outer guide member 18. However, when the front end of the roller holder 85 is located at a front side of the rear end of the guide rail 56 (for example, when the outer guide member 18 is at the first position), pivotal movement of the roller holder 85 is restricted by the guide rail 56.

The roller holder 85 pivotally moves between a third position shown in FIG. 2 and a fourth position shown in FIG. 4 by the solid lines.

As shown in FIGS. 2 and 3, when the outer guide member 18 is at the first position, the roller holder 85 is at the third position. When the roller holder 85 is at the third position, the rear side of a lower surface 96 of the roller holder 85 defines the outer side of the curved portion 33, and the front side of the lower surface 96 of the roller holder 85 defines the upper side of the extending portion 34. When the roller holder 85 is at the third position, each pinch roller 61 faces the conveying roller 60 and contacts the conveying roller 60 from above. The roller holder 85 at the third position extends substantially diagonally to a front-lower side from the shaft 94. With this arrangement, a gap is formed between the front side of the roller holder 85 and the lower surface 98 of the guide rail 56. The contact members 41 are arranged in this gap (see FIGS. 3 and 6).

In a state where the pinch roller 61 and the conveying roller 60 are in contact with each other, a shaft of the pinch roller 61 is located farther frontward than a shaft of the conveying roller 60. With this arrangement, a recording sheet held by the pair of conveying rollers 59 is conveyed diagonally in a front-lower direction, and is pressed against the platen 42. As a result, an interval between the recording head 38 and a recording sheet supported by the platen 42 is maintained at a constant distance.

As shown in FIG. 4, when the outer guide member 18 is at the second position, the roller holder 85 pivotally moves between a position indicated by the dashed lines (hereinafter referred to as "fifth position") and the fourth position indicated by the solid lines. A position of the roller holder 85 relative to the outer guide member 18 when the roller holder 85 is at the fifth position is slightly farther forward than a position of the roller holder 85 relative to the outer guide member 18 when the roller holder 85 is at the third position (the position indicated by the single-dot chain lines in FIG. 4). Note that the roller holder 85 is restricted from pivotally moving farther forward than the fifth position by a stopper (not shown) provided at the outer guide member 18. When the roller holder 85 pivotally moves from the third position or the fifth position in a direction of an arrow 97, the roller holder 85 is located farther rearward than the outer guide member 18 at the second position. The roller holder 85 at this time is located at the fourth position.

[Coil Spring 73 and Engaging Member 74]

As shown in FIGS. 2 and 3, the coil spring 73 and an engaging member 74 are provided at the roller holder 85. A plurality of the coil springs 73 and the engaging members 74 are provided with intervals therebetween in the left-right direction X. The coil spring 73 and the engaging member 74 are arranged between the contact members 41 that are adjacent in the left-right direction X. Each coil spring 73 is supported by the roller holder 85, and each engaging member 74 is supported by the coil spring 73. With this configuration, the coil spring 73 is provided between the roller holder 85 and the engaging member 74.

A lower end portion of the coil spring 73 is in contact with the roller holder 85, and an upper end portion of the coil spring 73 is in contact with the engaging member 74. A lower surface of the engaging member 74 is in contact with the upper end portion of the coil spring 73. An upper surface of the engaging member 74 is in contact with the lower surface 98 of the guide rail 56. A protrusion 75 is formed at the upper surface of the engaging member 74. On the other hand, an opening 76 is formed at a position of the guide rail 56 corresponding to each engaging member 74.

When the outer guide member 18 is at the first position and the roller holder 85 is at the third position, the protrusion 75 is urged upward by the coil spring 73 and thus inserted in the opening 76. With this configuration, the engaging member 74 and the guide rail 56 engage each other. In this state, each coil spring 73 is contracted to a shorter length than its natural length. Thus, the coil spring 73 urges each pinch roller 61 to the conveying roller 60 side. As a result, each pinch roller 61 is pressed against the conveying roller 60.

In the present embodiment, the coil spring 73 serves both as an urging member that urges the protrusion 75 upward and as an urging member that urges the pinch roller 61 toward the conveying roller 60 side. However, the urging member that urges the protrusion 75 upward may be different from the urging member that urges the pinch roller 61 toward the conveying roller 60 side.

When the outer guide member 18 is pivotally moved from the first position toward the second position in in the direction of the arrow 91, the protrusion 75 of the engaging member 74 contacts and presses a rear side surface 17 (inner surface) of the opening 76. With this configuration, the protrusion 75 receives reaction force from the rear side surface 17. The coil spring 73 contracts due to the reaction force. This causes the engaging member 74 to move downward, and the protrusion 75 comes out of the opening 76. As a result, the engaging member 74 and the guide rail 56 are disengaged, and the protrusion 75 contacts the lower surface 98 of the guide rail 56. While the protrusion 75 is guided along the lower surface 98, the roller holder 85 pivotally moves rearward integrally with the outer guide member 18.

On the other hand, when the outer guide member 18 is pivotally moved from the second position toward the first position in the direction of the arrow 91, the protrusion 75 contacts and presses the rear bent portion 53 of the guide rail 56. Thus, the protrusion 75 receives reaction force from the rear bent portion 53. The coil spring 73 contracts due to the reaction force. This causes the engaging member 74 to move downward, and the protrusion 75 contacts the lower surface 98 of the guide rail 56. As a result, the engaging member 74 enters inside of the casing 14 through a space between the guide rail 56 and the inner guide member 19. When the outer guide member 18 reaches the first position, the protrusion 75 is inserted in the opening 76 of the guide rail 56, and the engaging member 74 and the guide rail 56 engage each other.

[Regulating Member 80]

As shown in FIG. 6, the regulating member 80 is disposed above the contact member 41. In FIGS. 2 through 4, the regulating member 80 is not shown in the drawings. The regulating member 80 is molded by using, as the primary component, resin having a lower molding shrinkage ratio than polyacetal (POM) which is the primary component of the contact member 41. For example, the regulating member 80 is molded by using, as the primary component, resin such as polypropylene and ABS (acrylonitrile butadiene styrene).

The regulating member 80 includes one base end portion 81 and a plurality of protruding portions 82. The base end portion 81 extends in the left-right direction X. The plurality of protruding portions 82 is provided with intervals therebetween in the left-right direction X, and extends frontward from the base end portion 81. In FIG. 8, the plurality of protruding portions 82 is shown by the dashed lines for illustration purposes.

The base end portion 81 is attached to the front bent portion 54 of the guide rail 56. Note that, as a method of attaching the base end portion 45 to the front bent portion 54, various known methods such as fitting and screws may be adopted.

The protruding portion 82 is bent downward at its front end portion. The protruding portions 82 extends farther to the platen 42 side than the lower surface 32 in the upper-lower direction Z which is perpendicular to the lower surface 32 of the recording head 38. With this configuration, a lower end portion 84 of the protruding portions 82 (an example of an extending end portion) is located at a position lower than the lower surface 32 and higher than the platen 42.

The lower end portion 84 is in contact with the front end portion 46 of the contact member 41 from above. With this configuration, the front end portion 46 of the contact member 41 is positioned by the regulating member 80 (positioning member). The position of the front end portion 46 in this state is an example of a regulating position. In this way, the lower end portion 84 causes the front end portion 46 to be located at the regulating position that is closer to the platen 42 than the lower surface 32 is.

Note that a plurality of regulating members 80 may be arranged in the left-right direction X so as to correspond to respective ones of the front end portions 46 of the contact members 41.

Effects of Embodiment

According to the present embodiment, the ribs 43 and the front end portions 46 of the contact members 41 apply a wave form to a recording sheet that is conveyed in the conveying direction 15 by the pair of conveying rollers 59, at an upstream side of the nozzles 39 of the recording head 38 in the conveying direction 15. The front end portion 46 is located at the regulating position by the lower end portion 84 of the regulating member 80. The regulating member 80 is provided at the guide rail 56, and the lower end portion 84 extends to a position closer to the platen 42 than the lower surface 32 of the recording head 38 is. Thus, the regulating member 80 is disposed at a position close to the regulating position. Accordingly, respective positions of the front end portions 46 of the plurality of contact members 41 are stable (constant). Further, because the regulating member 80 is provided at the guide rail 56 supporting the recording device 24, positional relationship between the lower surface 32 and the regulating position has high accuracy.

According to the present embodiment, the contact member 41 has, as the primary component, resin having a higher molding shrinkage ratio than the resin that is the primary component of the regulating member 80. Hence, the front end portion 46 of the contact member 41 can be molded by using, as the primary component, resin suitable for contacting a recording sheet. On the other hand, the regulating member 80 can be molded by using, as the primary component, resin having high dimensional accuracy.

According to the present embodiment, the front end 47 of the front end portion 46 of the contact member 41 extends to a position closer to the nozzles 39 than the upstream end P1 with respect to the conveying direction 15. Hence, until just before a recording sheet reaches the nozzles 39 of the recording head 38, a wave form is maintained by the front end portions 46 of the contact members 41.

According to the present embodiment, the ribs 43 (an example of the second contact portion) applies a wave form to a recording sheet in a stable manner.

While the invention has been described in detail with reference to the above aspects thereof, it would be apparent to those skilled in the art that various changes and modifications may be made therein without departing from the scope of the claims.

First Modification

Figure 7:
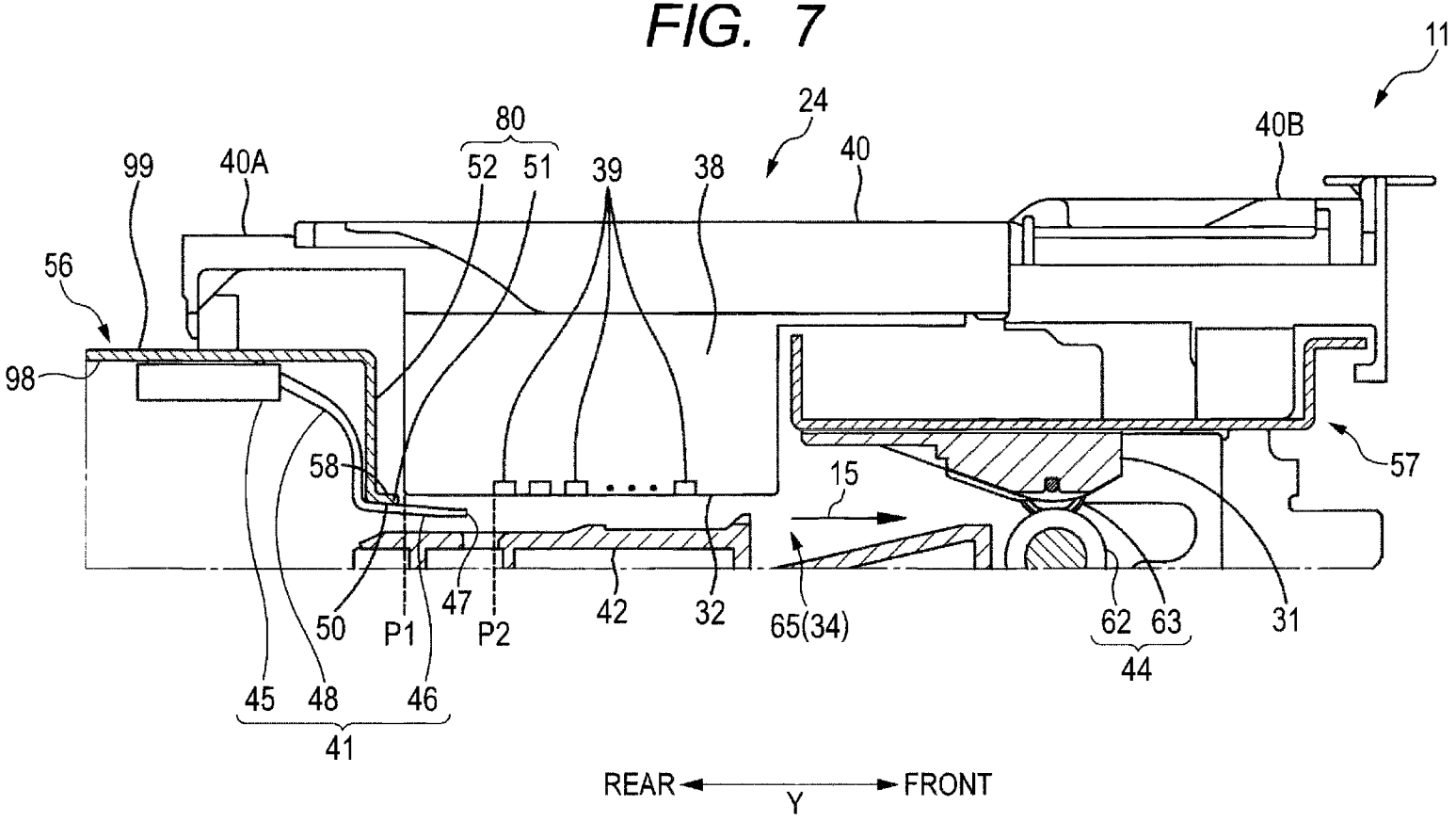
FIG. 7 is a vertical cross-sectional view schematically showing a recording device, guide rails, a contact member, and a regulating member according to a first modification.

The regulating member 80 may be formed as an integral part with the guide rail 56 that is a metal plate. In this case, as shown in FIG. 7, the guide rail 56 includes a first bent portion 52 that is bent downward at the front end portion, instead of the front bent portion 54. In the first modification, a second bent portion 51 (an example of the extending end portion) is provided at a lower end of the first bent portion 52. Note that, in FIG. 7, the second bent portion 51 extends from the first bent portion 52 to the downstream side in the conveying direction 15. However, the second bent portion 51 may extend to the upstream side in the conveying direction 15.

The second bent portion 51 is located at a position lower than the lower surface 32 and higher than the platen 42. A lower surface 50 of the second bent portion 51 (an example of a second surface) that is an opposite surface from the upper surface 99 of the guide rail 56 makes contact (surface contact: contact between surfaces) with the front end portion 46 of the contact member 41 from above. With this arrangement, the front end portion 46 of the contact member 41 is located at the regulating position mentioned in the above-described embodiment.

According to the first modification, because the regulating member 80 is formed integrally with the guide rail 56, the positional accuracy of the guide rail 56 and the regulating member 80 is improved.

In FIG. 7, a contact position between the guide rail 56 and the contact member 41 (hereinafter referred to as "first contact position") is located at a downstream side, in the conveying direction 15, of a contact position between the guide rail 56 and the carriage 40 (the rear end portion 40A) (hereinafter referred to as "second contact position"). However, the first contact position may be located at an upstream side of the second contact position in the conveying direction 15, or may be located at the same position as the second contact position in the conveying direction 15. For example, if the rear end portion 40A of the carriage 40 is provided at a position where the rear end portion 40A is in contact with the upper surface 58 of the second bent portion 51, the first contact position is at the same position as the second contact position with respect to the conveying direction 15.

Second Modification

In the above-described embodiment, the ribs 43 formed at the platen 42 serve as an example of the second contact portion, but the second contact portion is not limited to the ribs 43. Another example of the second contact portion is a plurality of rollers (not shown) arranged with intervals therebetween in the left-right direction X. The rollers are disposed at positions below the extending portion 34 and between the front end portions 46 that are adjacent in the left-right direction X. The upper ends of the rollers are located at a higher position than the lower surfaces of the front end portions 46. In this way, the front end portions 46 and the rollers cooperate with each other to apply a wave form to a recording sheet.

Other Modifications

In the above-described embodiment, the lower end of the front end 47 of the front end portion 46 is located at a lower position than the upper end of the rib 43. However, the lower end of the front end 47 may be located at the same position as the upper end of the rib 43 in the upper-lower direction Z, or may be located at a higher position than the upper end of the rib 43, depending on thickness of a sheet S, as long as a wave form is applied to the sheet S.

In the above-described embodiment, the conveying path 65 is formed such that the sheet S is conveyed horizontally (from the rear side to the front side) between the recording head 38 and the platen 42. However, the conveying direction is not limited to this, and may be vertical or slanted directions.

What is claimed is:

1. An image recording apparatus comprising:

a casing in which a conveying path is formed;

a roller pair arranged on the conveying path and configured to hold a sheet at a nipping position and to convey the sheet in a first direction;

a recording device comprising a recording head having a nozzle surface formed with nozzles, the recording head being configured to eject liquid through the nozzles onto the sheet conveyed by the roller pair, the recording device being configured to move in a second direction intersecting the first direction;

a metal frame fixedly provided in the casing, the metal frame being configured to support the recording device so as to be movable in the second direction, the metal frame being provided at a first side that is one side of the conveying path;

a supporting member configured to support the sheet, the supporting member provided at a second side that is an opposite side of the conveying path from the first side;

a contact portion comprising a first portion fixed to the metal frame and a second portion extending toward a space between the recording head and the supporting member, the second portion being configured to contact the sheet from the first side; and a regulating member fixedly provided at the metal frame, the regulating member being configured to contact the second portion of the contact portion from the first side at a position that is closer to the supporting member than the nozzle surface is with respect to a perpendicular direction perpendicular to the nozzle surface.

2. The image recording apparatus according to claim 1, wherein the regulating member, comprises a metal plate that is formed integrally with the metal frame.

3. The image recording apparatus according to claim 2, wherein the metal plate having a protruding portion extending from the first side toward the second side, an end portion of the protruding portion at the second side being configured to contact the second portion of the contact portion.

4. The image recording apparatus according to claim 1, wherein the regulating member consists primarily of resin having a first molding shrinkage ratio; and wherein the contact portion consists primarily of resin having a second molding shrinkage ratio higher than the first molding shrinkage ratio.

5. The image recording apparatus according to claim 1, wherein the recording device comprises a carriage having the recording head mounted thereon, the carriage being configured to move in the second direction; and wherein the metal frame supports the carriage so as to be movable in the second direction.

6. The image recording apparatus according to claim 1, wherein the regulating member extends to provide an extending end portion that is located at the position closer to the supporting member than the nozzle surface is with respect to the perpendicular direction, the extending end portion being configured to contact the second portion of the contact portion from the first side at the position that is closer to the supporting member than the nozzle surface is with respect to the perpendicular direction.

7. The image recording apparatus according to claim 6, wherein the extending end portion extends in the first direction such that the extending end portion makes surface contact with the second portion of the contact portion.

8. The image recording apparatus according to claim 1, wherein the regulating member is configured not to contact the sheet.

9. The image recording apparatus according to claim 1, wherein the regulating member is provided at a downstream end of the metal frame in the first direction; and wherein the first portion of contact portion is fixed to a lower surface of the metal plate.

10. The image recording apparatus according to claim 1, wherein the contact portion further comprises a curved portion extending toward a downstream side in the first direction and toward the second side, while curving, from the first portion;

wherein the second portion is provided at the downstream side of the curved portion and extending substantially in the first direction; and wherein the regulating member is provided at a downstream end of the metal frame in the first direction, the regulating member having a protruding portion extending from the first side toward the second side, an end portion of the protruding portion at the second side being configured to contact the second portion of the contact portion.

* * * * *